US007967164B1

(12) United States Patent
Mountain

(10) Patent No.: US 7,967,164 B1
(45) Date of Patent: Jun. 28, 2011

(54) LEAKAGE CONTAINMENT DEVICE

(76) Inventor: Fulton T. Mountain, Barrington, NH (US)

( * ) Notice: Subject to any disclaimer, the term of this patent is extended or adjusted under 35 U.S.C. 154(b) by 1153 days.

(21) Appl. No.: 11/351,479

(22) Filed: Feb. 13, 2006

(51) Int. Cl.
*B65D 1/42* (2006.01)
*B65D 6/34* (2006.01)
*B65D 8/08* (2006.01)
*B65D 25/54* (2006.01)

(52) U.S. Cl. ..... 220/560.03; 220/377; 220/651; 220/662; 220/663; 220/669; 220/676; 220/810; 220/836; 220/913

(58) Field of Classification Search ..... 220/23.87, 220/377, 560.03, 651–654, 662–663, 669, 220/676, 810, 820, 831, 836, 646, 913, DIG. 27; 210/455
See application file for complete search history.

(56) References Cited

U.S. PATENT DOCUMENTS 3,394,835 A * 7/1968 Peterson ..... 220/833
4,871,084 A 10/1989 Robbins
4,912,966 A 4/1990 Sharp
5,022,527 A * 6/1991 Braeutigam ..... 206/522
5,071,166 A * 12/1991 Marino ..... 280/830
5,114,271 A 5/1992 Sunderhaus et al.
D343,887 S 2/1994 Shed et al.
5,313,991 A 5/1994 Murray et al.
5,417,344 A * 5/1995 Wells et al. ..... 220/571
5,555,999 A * 9/1996 Wilcox ..... 220/565
5,884,709 A * 3/1999 Evans et al. ..... 169/46
5,957,322 A * 9/1999 Pugh ..... 220/560.03
6,006,588 A * 12/1999 Cartwright et al. ..... 73/49.2
6,085,664 A * 7/2000 Early ..... 105/377.07
6,149,026 A 11/2000 Manson
6,176,721 B1 * 1/2001 Gottardo et al. ..... 439/260
6,264,713 B1 * 7/2001 Lewis, II ..... 55/481

* cited by examiner

*Primary Examiner* — Anthony Stashick
*Assistant Examiner* — Madison L Wright
(74) *Attorney, Agent, or Firm* — David M. Driscoll, Esq.

(57) ABSTRACT

A leakage containment device for containing leakage from an oil tank supplying oil to a heating system includes a container including a bottom wall and a perimeter wall being coupled to and extending upwardly from the bottom wall to define an interior space. An upper edge of the perimeter wall defines an upper open end of the container to permit an oil tank to be placed in the interior space. A lid is hingedly coupled to the upper edge of the perimeter wall. The lid selectively closes the upper open end of the container when the lid is in a closed position over the upper open end. The lid is pivoted away from the upper open end to permit access to the upper open end.

20 Claims, 4 Drawing Sheets

LEAKAGE CONTAINMENT DEVICE

BACKGROUND OF THE INVENTION

1. Field of the Invention

The present invention relates to spill containment devices and more particularly pertains to a new spill containment device for containing leakage from an oil tank supplying oil to a heating system.

2. Description of the Prior Art

The use of spill containment devices is known in the prior art. U.S. Pat. No. 5,111,271 describes a device for connecting to and extending around a riser pipe and containing spills that occur when a supply pipe is connected to the riser pipe. Another type of spill containment device is U.S. Pat. No. 5,313,991 for being positioned around loading and unloading connection to catch and retain spillage from the connection during the loading and unloading process. Another type of spill containment device is U.S. Pat. No. 5,313,991 for providing additional containment around access pipe fittings of underground storage tanks.

While these devices fulfill their respective, particular objectives and requirements, the need remains for a device that has certain improved features allowing for containment of an above ground oil tank and containing any leakage from the oil tank to minimize environmental impact and to facilitate reclamation of product leaked from the oil tank.

SUMMARY OF THE INVENTION

The present invention meets the needs presented above by generally comprising a container including a bottom wall and a perimeter wall being coupled to and extending upwardly from the bottom wall to define an interior space. An upper edge of the perimeter wall defines an upper open end of the container to permit an oil tank to be placed in the interior space. A lid is hingedly coupled to the upper edge of the perimeter wall. The lid selectively closes the upper open end of the container when the lid is in a closed position over the upper open end. The lid is pivoted away from the upper open end to permit access to the upper open end.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
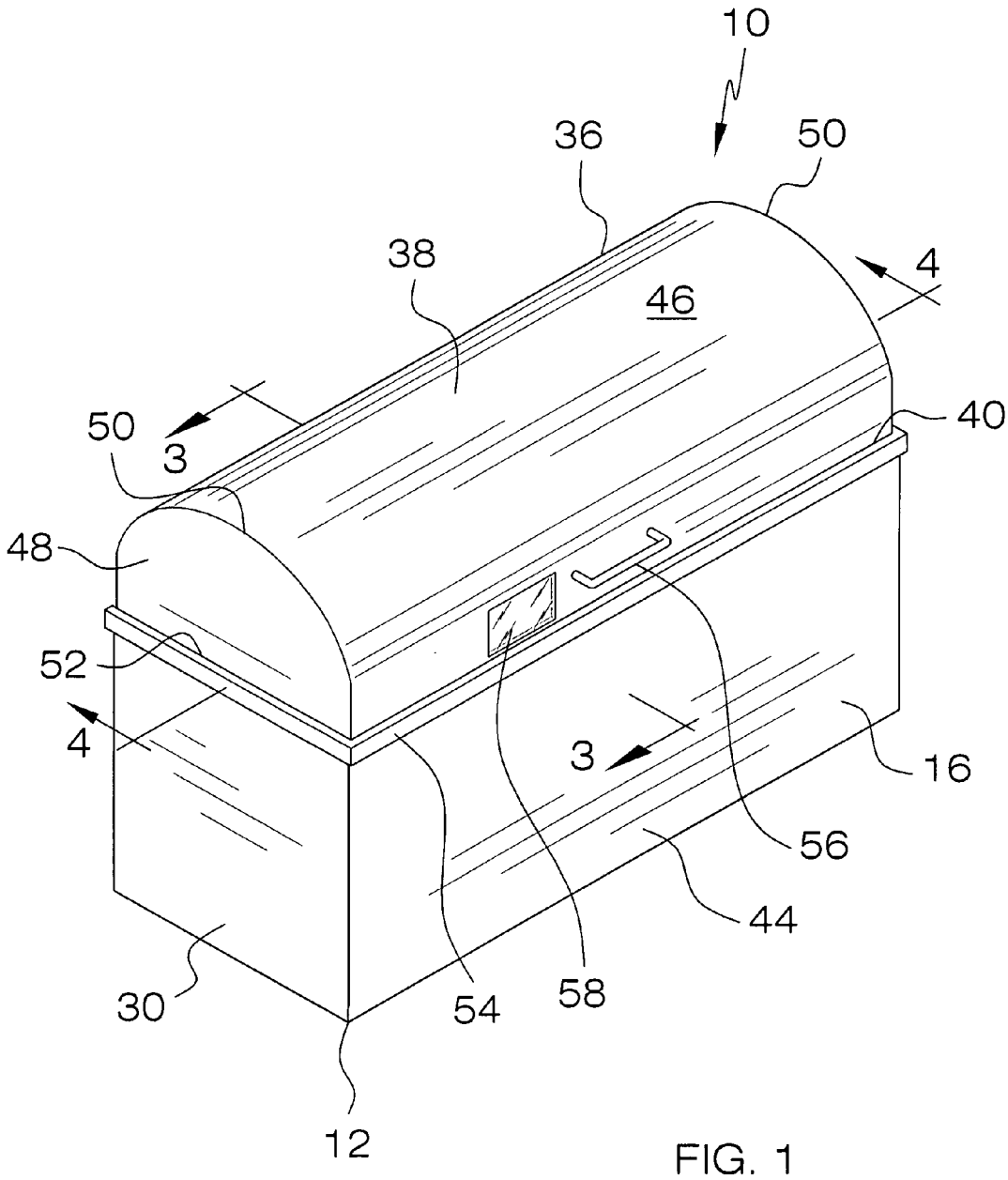
FIG. 1 is a perspective view of a leakage containment device according to the present invention.
Figure 2:
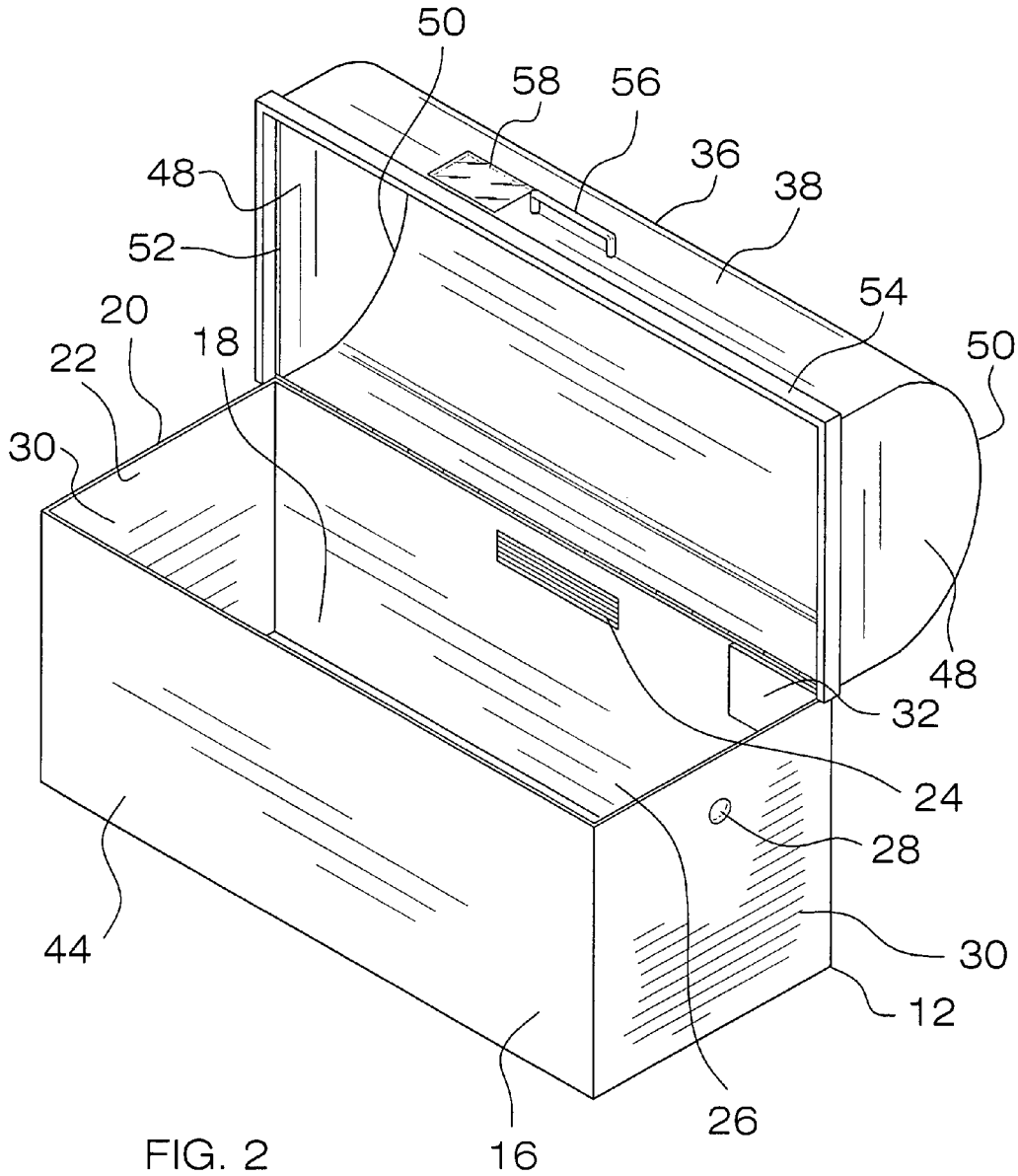
FIG. 2 is a perspective view of the present invention with the lid pivoted away from the upper open end.
Figure 3:
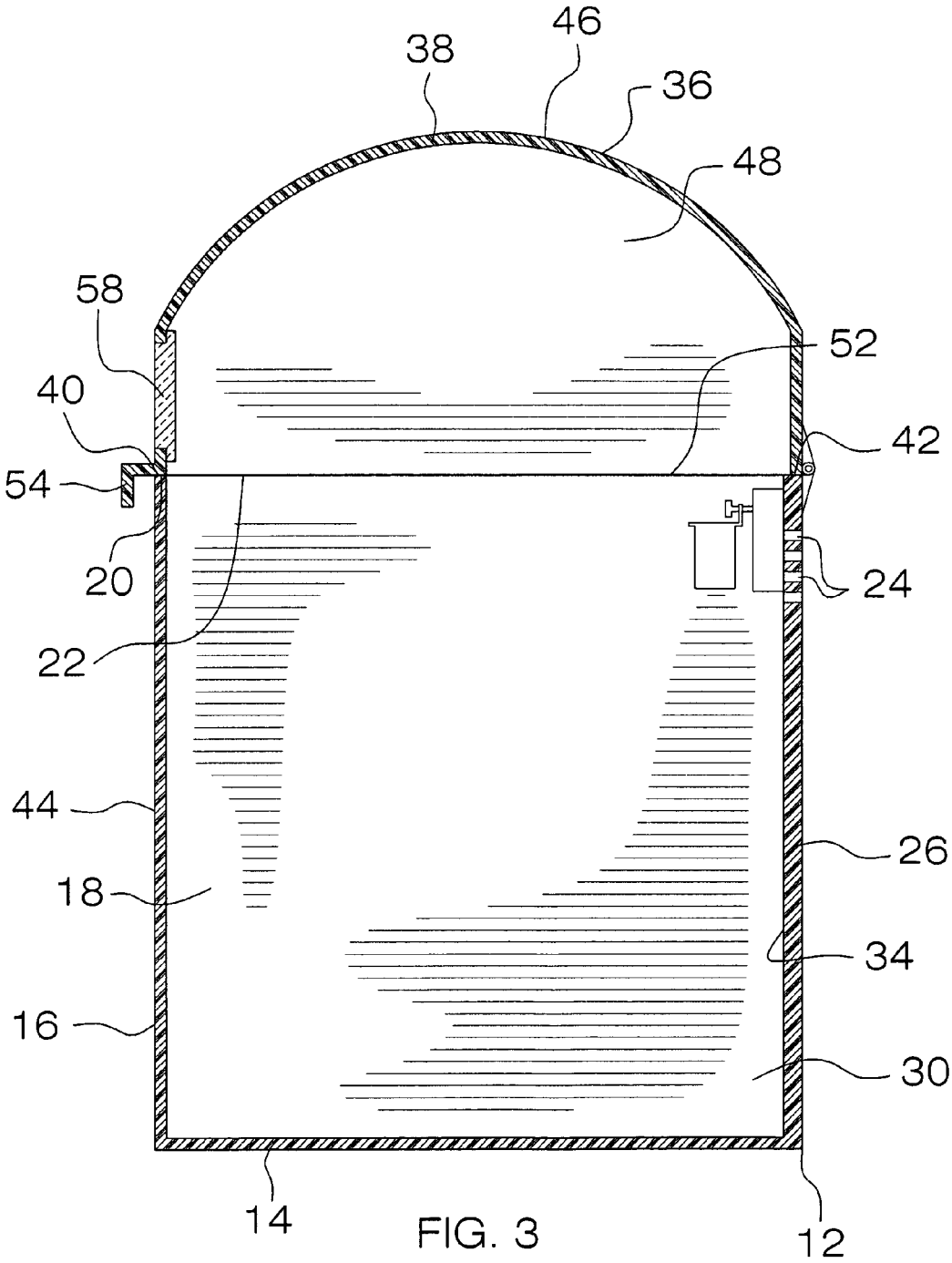
FIG. 3 is a cross-sectional view of the present invention taken along line 3-3 of FIG. 1.
Figure 4:
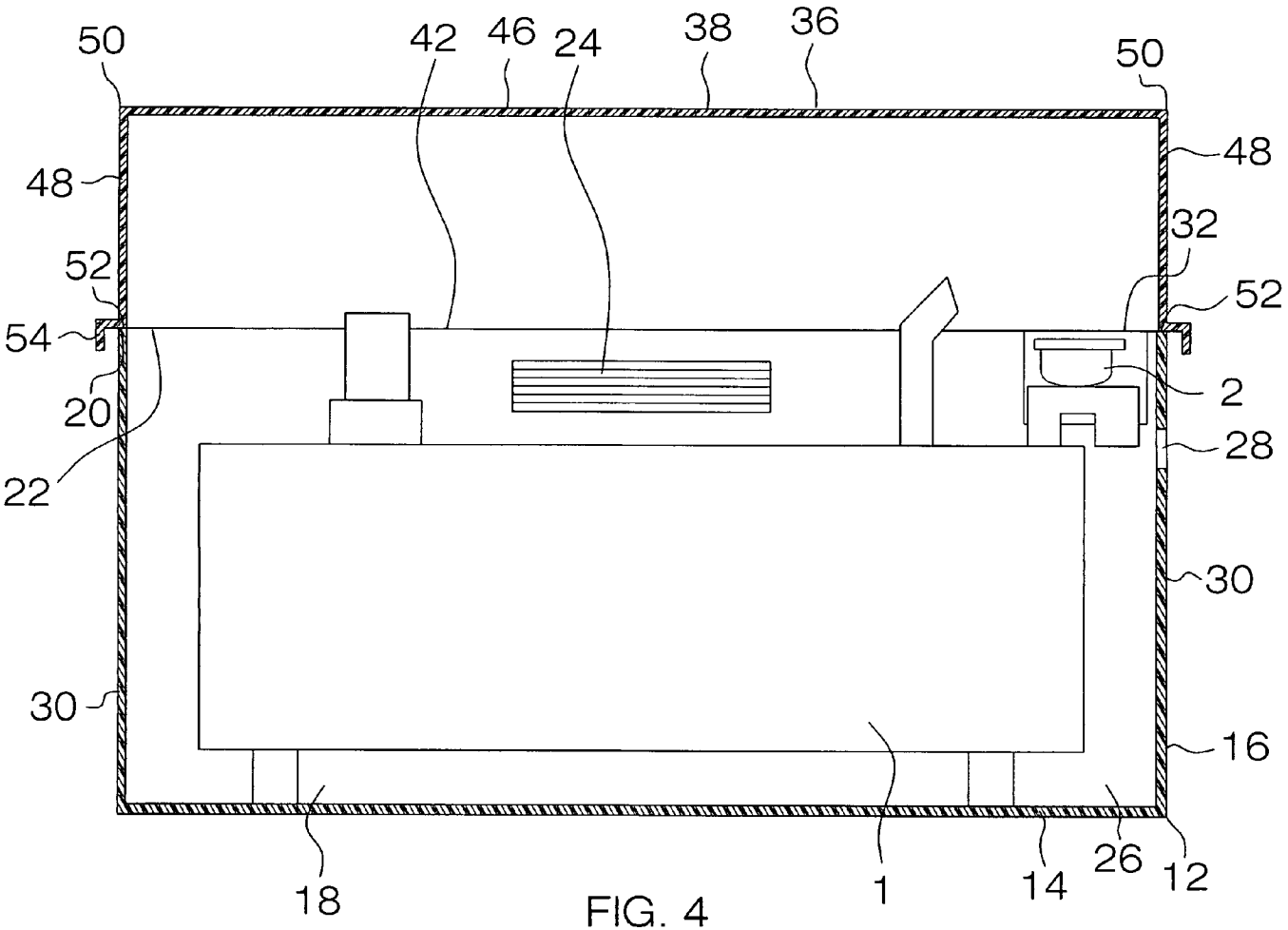
FIG. 4 is a cross-sectional view of the present invention taken along line 4-4 of FIG. 1.

With reference now to the drawings, and in particular to FIGS. 1 through 4 thereof, a new spill containment device embodying the principles and concepts of the present invention and generally designated by the reference numeral 10 will be described.

As best illustrated in FIGS. 1 through 4, the leakage containment device 10 generally comprises a container 12 including a bottom wall 14 and a perimeter wall 16 coupled to and extending upwardly from the bottom wall 14 to define an interior space 18. An upper edge 20 of the perimeter wall 16 defines an upper open end 22 of the container 12 to permit an oil tank 1 to be placed in the interior space 18. The perimeter wall 16 has a plurality of vent apertures 24 extending through a rear portion 26 of the perimeter wall 16 to permit air circulation between the interior space 18 and the environment to inhibit gasses from collecting in the interior space 18. The perimeter wall 16 has an access aperture 28 extending through one of a pair of side portions 30 of said perimeter wall 16 to permit the oil tank 1 to be connected to a heating system. The container 12 comprises a plastic material to resist damage from exposure to environmental elements and petroleum products.

A reinforcement plate 32 is coupled to an interior surface 34 of the perimeter wall 16. The reinforcement plate 32 reinforces a portion of the rear portion 26 of the perimeter wall 16 to receive a filter 2. The reinforcement plate 32 inhibits the filter 2 from pulling through the perimeter wall 16 when the filter 2 is coupled to the reinforcement plate 32 and the perimeter wall 16.

A lid 36 is hingedly coupled to the upper edge 20 of the perimeter wall 16. The lid 36 selectively closes the upper open end 22 of the container 12 when the lid 36 is in a closed position over the upper open end 22. The lid 36 is pivoted away from the upper open end 22 to permit access to the upper open end 22. The lid 36 comprises a plastic material to resist damage from exposure to environmental elements and exposure to petroleum products. The lid 36 includes a top wall 38 having a front end 40 and back end 42. The back end 42 is hingedly coupled to the rear portion 26 of the perimeter wall 16. The rear portion 26 of the perimeter wall 16 has a thickness greater than the rest of the perimeter wall 16 to support a weight of the lid 36 when the lid 36 is pivoted to allow access to the interior space 18. The front end 40 is positioned adjacent a front portion 44 of the perimeter wall 16 opposite the rear portion 26 when the lid 36 is in the closed position. The top wall 38 has an upper surface 46 being substantially convexly arcuate to inhibit collection of rain and snow on the lid 36 when the lid 36 is in the closed position.

The lid 36 also includes a pair of side walls 48. Each of the side walls 48 is integrally coupled to one of a pair of side edges 50 of the top wall 38. Each of the side walls 48 has a bottom end 52 extending between the front end 40 and the back end 42 of the top wall 38. The bottom end 52 of each of the side walls 48 is positioned adjacent one of the pair of side portions 30 of the perimeter wall 16 when the lid 36 is in the closed position. A lip 54 is coupled to the front end 40 of the top wall 38 and the bottom end 52 of each of the side walls 48. The lip 54 extends outwardly and downwardly from the top wall 38 and the side walls 48 to extend over a portion of the perimeter wall 16 when the lid 36 is in the closed position. A handle 56 is coupled to the top wall 38 adjacent the front end 40. A window 58 is positioned in the top wall 38. The window 58 is positioned adjacent to the front end 40 to permit viewing of status gauges of the oil tank 1 when the lid 36 is in the closed position.

In use, the oil tank 1 is inserted into the interior space 18 of the container 12. The filter 2 is mounted to the reinforcement plate 32 and connected to the oil tank 1. The connection to the heating system is extended through the access aperture 28 and connected to the filter 2. The lid 36 is the pivoted over the upper open end 22 to inhibit rain, dirt and snow from entering the interior space 18 of the container 12. The status gauges of the oil tank 1 can be viewed through the window 58 to determine an amount of oil in the oil tank 1 when the lid 36 is in the closed position. To fill the tank, the lid 36 is opened to allow access to the oil tank 1.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A leakage containment device for containing leaks from an oil tank, said device comprising:

a container including a bottom wall and a perimeter wall being coupled to and extending upwardly from said bottom wall to define an interior space, an upper edge of said perimeter wall defining an upper open end of said container to permit the oil tank to be placed in said interior space; and a lid being hingedly coupled to said upper edge of said perimeter wall, said lid selectively closing said upper open end of said container when said lid is in a closed position over said upper open end, said lid being pivoted away from said upper open end to permit access to said upper open end, said lid including a top wall having a front end and back end, said back end being hingedly coupled to a rear portion of said perimeter wall, said front end being positioned adjacent a front portion of said perimeter wall opposite said rear portion when said lid is in said closed position, said top wall having an upper surface being substantially convexly arcuate to inhibit collection of rain and snow on said lid when said lid is in said closed position;

said container bottom wall being flat so as to rest on a flat ground support surface;

said oil tank including legs at a bottom for the support of the oil tank on the bottom flat wall of the container;

said oil tank also including a top thereof that is disposed below the lid so that the entire oil tank is within the container and does not extend upwardly into the lid;

wherein said perimeter wall has an access aperture extending therethrough to permit the oil tank to be connected to a heating system, said access aperture located at a height of the perimeter wall that aligns with a top of the oil tank.

2. The device according to claim 1, wherein said perimeter wall has a plurality of vent apertures extending therethrough to permit air circulation between said interior spaces and the environment.

3. The device according to claim 1, wherein said container comprises a plastic material to resist damage from exposure to environmental elements and exposure to petroleum products.

4. The device according to claim 1, further comprising a reinforcement plate being coupled to an interior surface of said perimeter wall, said reinforcement plate reinforcing a portion of said perimeter wall to receive a filter, wherein said reinforcement plate inhibits the filter from pulling through said perimeter wall when the filter is coupled to said reinforcement plate and said perimeter wall.

5. The device according to claim 1, wherein said lid comprises a plastic material to resist damage from exposure to environmental elements and exposure to petroleum products.

6. The device according to claim 1, wherein said rear portion of said perimeter wall has a thickness greater than the rest of said perimeter wall to support a weight of said lid when said lid is pivoted to allow access to said interior space, said rear portion being thickened along an entire vertical height of said rear portion.

7. The device according to claim 1, wherein said lid includes a pair of side walls, each of said side walls being integrally coupled to one of a pair of side edges of said top wall, each of said side walls having a bottom end extending between said front end and said back end of said top wall, said bottom end of each of said side walls being positioned adjacent one of a pair of side portions of said perimeter wall when said lid is in said closed position.

8. The device according to claim 7, wherein said lid includes a lip being coupled to said front end of said top wall and said bottom end of each of said side walls, said lip extending outwardly and downwardly from said top wall and said side walls to extend over a portion of said perimeter wall when said lid is in said closed position.

9. The device according to claim 1, wherein said lid includes a handle being coupled to said top wall adjacent said front end.

10. The device according to claim 1, wherein said lid includes a window being positioned in said top wall, said window being positioned adjacent to said front end to permit viewing of status gauges of the oil tank when said lid is in the closed position, said front end forming a bottom edge of said top wall, said window being vertically orientated when said lid is in said closed position.

11. The device according to claim 1 wherein the top wall of said lid is formed by front and back substantially straight upright vertical wall portions that are contiguous with the substantially convexly arcuate top portion.

12. A leakage containment device for containing leaks from an oil tank, said device comprising:

a container including a bottom wall and a perimeter wall being coupled to and extending upwardly from said bottom wall to define an interior space, an upper edge of said perimeter wall defining an upper open end of said container to permit the oil tank to be placed in said interior space, said perimeter wall having a plurality of vent apertures extending therethrough to permit air circulation between said interior space and the environment, said perimeter wall having an access aperture extending therethrough to permit the oil tank to be connected to a heating system, said access aperture located at a height of the perimeter wall that aligns with a top of the oil tank, said container comprising a plastic material to resist damage from exposure to environmental elements and exposure to petroleum products;

a reinforcement plate being coupled to an interior surface of said perimeter wall, said reinforcement plate reinforcing a portion of said perimeter wall to receive a filter, wherein said reinforcement plate inhibits the filter from pulling through said perimeter wall when the filter is coupled to said reinforcement plate and said perimeter wall;

a lid being hingedly coupled to said upper edge of said perimeter wall, said lid selectively closing said upper open end of said container when said lid is in a closed position over said upper open end, said lid being pivoted away from said upper open end to permit access to said upper open end, said lid comprising a plastic material to resist damage from exposure to environmental elements and exposure to petroleum products, said lid comprising:

a top wall having a front end and back end, said back end being hingedly coupled to a rear portion of said perimeter wall, said front end being positioned adjacent a front portion of said perimeter wall opposite said rear portion when said lid is in said closed position, said top wall having an upper surface being substantially convexly arcuate to inhibit collection of rain and snow on said lid when said rid is in said closed position;

a pair of side walls, each of said side walls being integrally coupled to one of a pair of side edges of said top wall, each of said side walls having a bottom end extending between said front end and said back end of said top wall, said bottom end of each of said side walls being positioned adjacent one of a pair of side portions of said perimeter wall when said lid is in said closed position;

a lip being coupled to said front end of said top wall and said bottom end of each of said side walls, said lip extending outwardly and downwardly from said top wall and said side walls to extend over a portion of said perimeter wall when said lid is in said closed position;

a handle being coupled to said top wall adjacent said front end; and a window being positioned in said top wall, said window being positioned adjacent to said front end to permit viewing of status gauges of the oil tank when said lid is in the closed position;

said container bottom wall being flat so as to rest on a flat support surface;

said oil tank including legs at a bottom for the support of the oil tank on the bottom flat wall of the container;

said oil tank also including a top thereof that is disposed below the lid so that the entire oil tank is within the container and does not extend upwardly into the lid.

13. The device according to claim 1 wherein the bottom wall and peripheral wall define a closed volume that is greater than a storage volume of the oil tank.

14. The device according to claim 13 wherein the oil tank is disposed entirely within the closed volume of the container.

15. The device according to claim 14 further comprising a reinforcement plate being coupled to an interior surface of said perimeter wall, said reinforcement plate reinforcing a portion of said perimeter wall to receive a filter, wherein said reinforcement plate inhibits the filter from pulling through said perimeter wall when the filter is coupled to said reinforcement plate and said perimeter wall.

16. The device according to claim 15 wherein said access aperture is disposed adjacent to said reinforcement plate and filter.

17. The device according to claim 16 wherein the top wall of said lid is formed by front and back substantially straight upright vertical wall portions that are contiguous with the substantially convexly arcuate top portion.

18. The device according to claim 17 wherein said lid includes a pair of side walls, each of said side walls being integrally coupled to one of a pair of side edges of said top wall, each of said side walls having a bottom end extending between said front end and said back end of said top wall, said bottom end of each of said side walls being positioned adjacent one of a pair of side portions of said perimeter wall when said lid is in said closed position; wherein said lid includes a lip being coupled to said front end of said top wall and said bottom end of each of said side walls, said lip extending outwardly and downwardly from said top wall and said side walls to extend over a portion of said perimeter wall when said lid is in said closed position; wherein said lid includes a handle being coupled to said top wall adjacent said front end; and wherein said lid includes a window being positioned in said top wall, said window being positioned adjacent to said front end to permit viewing of status gauges of the oil tank when said lid is in the closed position, said front end forming a bottom edge of said top wall, said window being vertically orientated when said lid is in said closed position.

19. The device according to claim 18 wherein said rear portion of said perimeter wall has a thickness greater than the rest of said perimeter wall to support a weight of said lid when said lid is pivoted to allow access to said interior space, said rear portion being thickened along an entire vertical height of said rear portion.

20. The device according to claim 19 wherein said perimeter wall has a plurality of vent apertures extending therethrough to permit air circulation between said interior spaces and the environment, said vent apertures disposed at a rear of the perimeter wall of the container.

* * * * *